United States Patent [19]

Jones

[11] 4,132,267

[45] Jan. 2, 1979

[54] PIPE SHEARING RAM ASSEMBLY FOR BLOWOUT PREVENTER

[75] Inventor: Marvin R. Jones, Houston, Tex.

[73] Assignee: Cameron Iron Works, Inc., Houston, Tex.

[21] Appl. No.: 893,978

[22] Filed: Apr. 6, 1978

[51] Int. Cl.[2] ..... E21B 29/00

[52] U.S. Cl. ..... 166/55; 251/1 A

[58] Field of Search ..... 166/55, 55.1, 55.2, 166/55.3; 251/1 A, 1 R; 30/92

[56] References Cited

U.S. PATENT DOCUMENTS

| | | | |
|---|---|---|---|
| 2,919,111 | 12/1959 | Nicolson | 166/55 X |
| 2,969,838 | 1/1961 | Wilde | 166/55 |
| 3,379,255 | 4/1968 | Burns, Jr. et al. | 166/55 |
| 3,561,526 | 2/1971 | Williams, Jr. | 166/55 |
| 3,736,982 | 6/1973 | Vujasinovic | 251/1 A X |
| 3,817,326 | 6/1974 | Meynier | 166/55 |

*Primary Examiner*—Ernest R. Purser
*Assistant Examiner*—Richard E. Favreau
*Attorney, Agent, or Firm*—Vinson & Elkins

[57] ABSTRACT

A shear ram assembly for a blowout preventer having a pair of opposed shear blades, means for moving the shear blades across the pipe opening of the blowout preventer, a shoulder on one ram spaced below the shearing plane of the blades, a face seal mounted in a recess above said shoulder and below said shearing plane, the leading face of the lower blade coacting with said shoulder to bend a sheared pipe section remaining in its path on said shoulder so that there is no pipe or debris between said leading face and said face seal.

2 Claims, 4 Drawing Figures

PIPE SHEARING RAM ASSEMBLY FOR BLOWOUT PREVENTER

BACKGROUND

Prior art blowout preventer shear rams include a type in which a seal is provided for the face or faces of the shear blades to seal against (U.S. Pat. No. 3,651,526 to L. E. Williams, Jr. et al) and another type in which the seal for the blades is contained in a recess in one of the blades to seal against the other shear blade along the shear plane (U.S. Pat. No. 3,817,326 to M. J. Meynier III and U.S. Pat. No. 3,736,982 to A. N. Vujasinavic). For each time these rams are operated to shear, they are operated a great number of times to act as blind rams. The service life of such shear rams is limited by excessive ram packing forces which result from limited packing area and the excessively wide crack between confronting blade surfaces which is bridged by packing. Also with the prior art pipe shear rams for blowout preventers little attention is given to assure that the pieces of the sheared pipe do not interfere with the sealing.

SUMMARY

The present invention relates to an improved shear ram assembly for a blowout preventer.

The improved shear ram assembly includes opposed shear blades, the ram having a face seal below the shearing plane and a shoulder spaced below and inward of the face seal to coact with the leading face of the lower shear blade to bend sheared pipe sections on said shoulder out of the path of said leading face of said lower shear blade toward sealing engagement with said face seal, the shear blades being positioned so that any debris resulting from the shearing of the pipe does not collect in the path of said lower shear blade but falls through the pipe opening of the blowout preventer.

BRIEF DESCRIPTION OF THE DRAWINGS

These and other advantages of the improved structure of the present invention are hereinafter set forth and explained with reference to the drawings wherein.

DESCRIPTION OF THE PREFERRED EMBODIMENT

Figure 1:
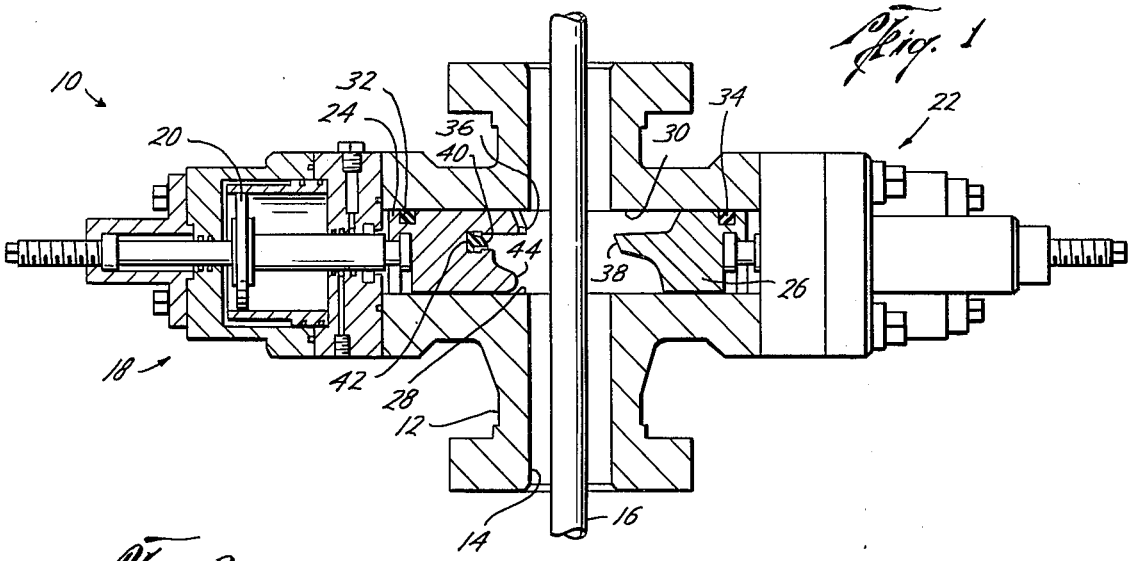
FIG. 1 is a side view partially in section of a blowout preventer having the improved ram assembly of the present invention in retracted position.

The blowout preventor 10 shown in FIG. 1 is generally of the usual design including the body 12 having the pipe bore 14 through which pipes such as 16 are adapted to extend, the improved shear ram assembly 18 of the present invention and the pressure responsive means 20 and 22 for moving the rams 24 and 26 toward each other into sealed position for closing pipe bore 14 and for retracting the rams 24 and 26 from such position.

Figure 2:
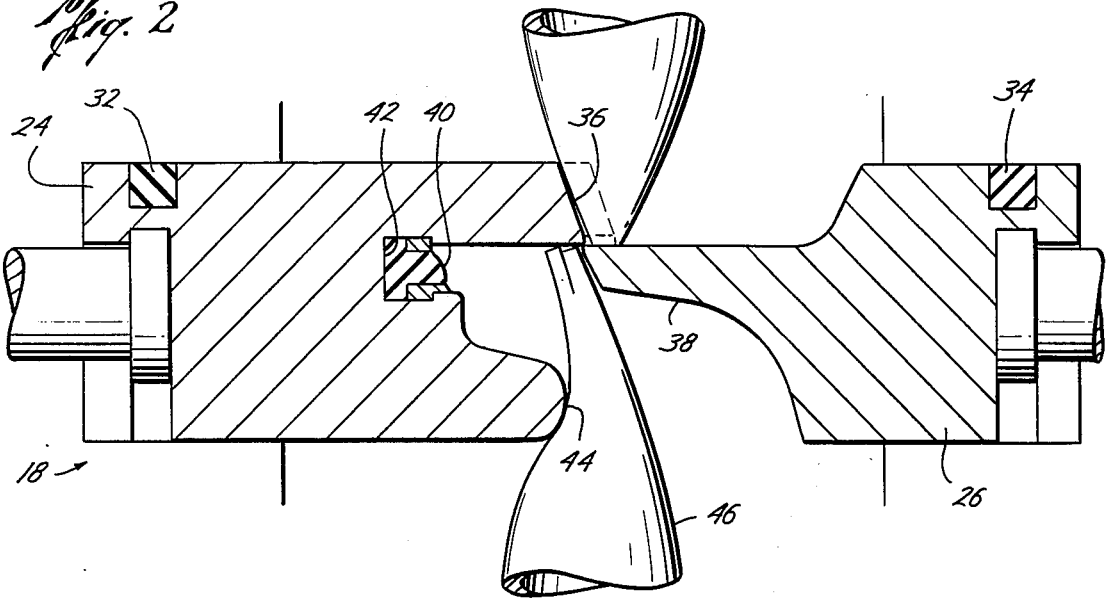
FIG. 2 is a detail sectional view of the rams immediately following the shearing of a pipe.
Figure 4:
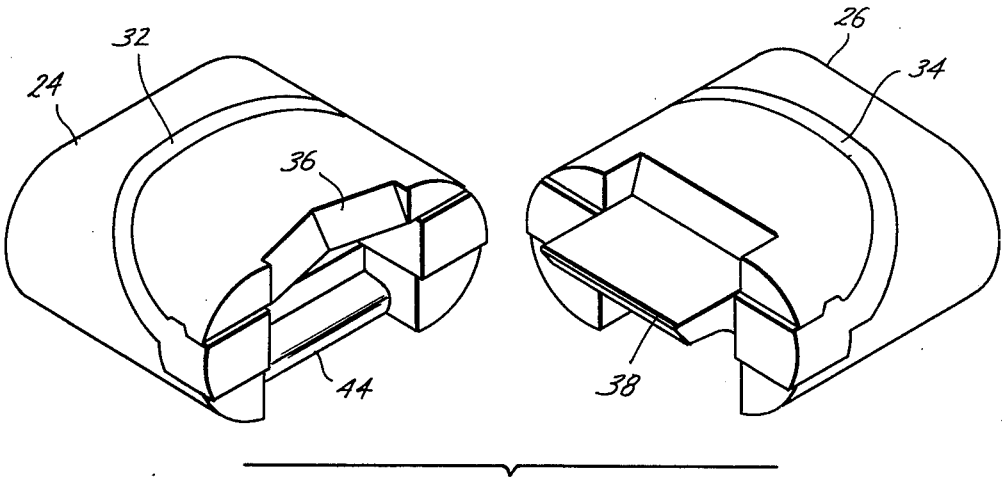
FIG. 4 is an isometric view of the ram assembly.

Shear ram assembly 18 includes rams 24 and 26, slidable in the guideways 28 and 30 within body 12 and provided with suitable sealing means 32 and 34. The ram 24 has shear blade 36 projecting toward 26 which has the projecting shear blade 38. Both shear blades 36 and 38 are of the usual design with the central portion of at least one blade recessed and side portions extending toward the other ram to provide some centering of the pipe 16 as the rams close thereon. This blade contour is clearly shown in FIG. 4 and is similar to the blade contour disclosed in the aforementioned Meynier U.S. Pat. No. 3,818,326. Blade 36 coacts with blade 38 to shear pipe 16, as shown in FIG. 2 along the shearing plane which is established along the lower surface of blade 36 and along the upper surface of blade 38. The shearing plane may actually allow a small gap between the upper and lower blades to avoid interference thereof.

Figure 3:
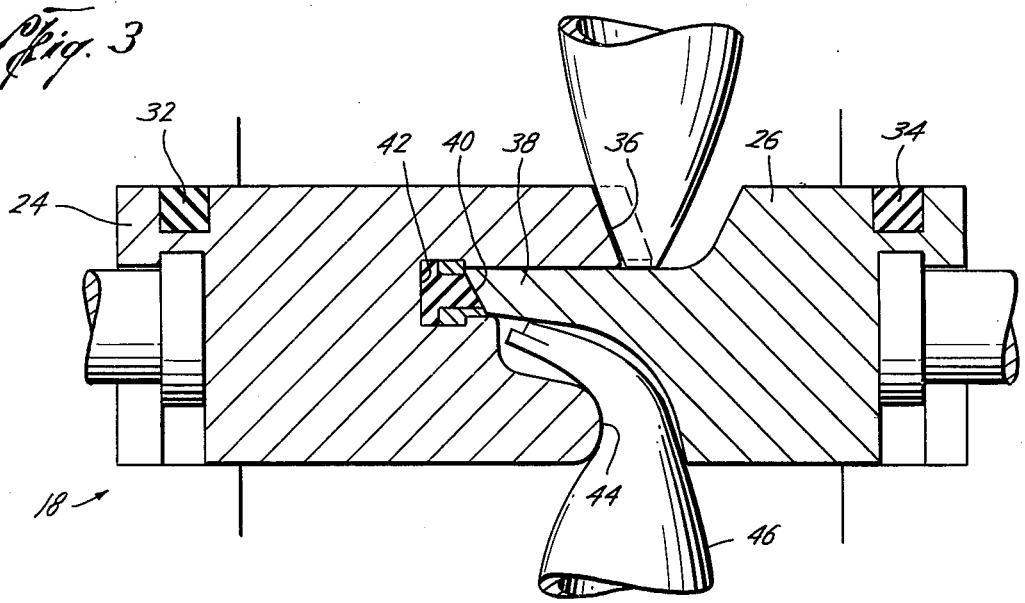
FIG. 3 is another detail sectional view of the rams illustrating their sealing position following shearing of a pipe.

Ram 24 includes the face seal 40 positioned within the recess 42 and the shoulder 44 which projects inward beyond face seal 40. Shoulder 44 is spaced inward of and below face seal 40 a sufficient distance so that the leading face of blade 38 engages the lower cut section 46 of pipe 16, bends it on the shoulder 44 and moves into sealing engagement with face seal 40. This face sealing position is shown in FIG. 3 and, the pipe section 46 has been bent on shoulder 44 out of the path of the forward face of blade 38 so that it does not interfere with the face seal between the rams.

In shearing pipe with blowout preventer shear rams small pieces of metal and other debris may break loose from the pipe 16. With a structure similar to that shown in the drawings and described above but with the position of the two shear blades inverted, debris may collect in the path of the leading face of the blade moving toward sealing engagement with the face seal. The significant contribution of the present invention is the inversion of the shear blades of such structure so that any debris formed falls through the pipe opening of the blowout preventer and does not interfere with the shear blade sealing.

What is claimed is:

1. A blowout preventer comprising, a body having a pipe opening therethrough, ram guideways extending laterally from opposite sides of the pipe opening, a ram assembly comprising first and second rams, each located in one of the ram guideways, and means for moving the rams together to close off the pipe opening and for moving the rams apart to open the pipe opening, each ram having a shear blade attached thereto in position for the cutting edge of the blade on said second ram to pass just below the cutting edge of the blade on the said first ram to shear any pipe positioned in the pipe opening when the rams are moved together to close off the opening, seal means around said rams including a seal positioned in said first shear ram at a location to be engaged by the leading face of the lower shear blade of said second shear ram, and inwardly extending transverse shoulder on said first ram spaced below and projecting inwardly beyond said seal whereby the end of a sheared pipe remaining in said pipe opening is engaged by and bent on said shoulder out of the path of said lower shear blade so that said lower shear blade may seal against said seal, said seal being positioned below said upper shear blade so that debris resulting from shearing pipe falls into said pipe opening and does not interfere with the sealing engagement between said seal and said lower shear blade.

2. A shear ram assembly for a ram-type blowout preventer comprising first and second rams, each ram having a shear blade in position for the cutting edge of the blade on the first ram to pass just below the cutting edge of the blade on the second ram to shear any pipe positioned in the pipe opening when the rams are moved together to close off the opening, sealing means including a seal positioned in said second ram at a location to be engaged by the leading face of the shear blade of said first ram, and an inwardly extending transverse shoulder on said second ram spaced below and projecting inwardly beyond said seal whereby the end of a sheared pipe remaining in said pipe opening is engaged by and bent around said shoulder out of the path of said lower shear blade so that said lower shear blade may seal against said seal, said seal being positioned below said upper shear blade so that debris resulting from shearing pipe falls into said pipe opening and does not interfere with the sealing engagement between said seal and said lower shear blade.

* * * * *